US008105702B2

(12) United States Patent
Pitonak et al.

(10) Patent No.: US 8,105,702 B2
(45) Date of Patent: Jan. 31, 2012

(54) INDEXABLE INSERT WITH A MULTI-LAYER COATING

(75) Inventors: Reinhard Pitonak, Bruck/Mur (AT); Ronald Weissenbacher, Bruck/Murr (AT)

(73) Assignee: Boehlerit GmbH & Co. KG., Kapfenberg (AT)

( * ) Notice: Subject to any disclaimer, the term of this patent is extended or adjusted under 35 U.S.C. 154(b) by 661 days.

(21) Appl. No.: 11/572,690

(22) PCT Filed: Jul. 18, 2005

(86) PCT No.: PCT/AT2005/000281

§ 371 (c)(1),
(2), (4) Date: Jan. 25, 2007

(87) PCT Pub. No.: WO2006/012656

PCT Pub. Date: Feb. 9, 2006

(65) Prior Publication Data

US 2008/0044242 A1 Feb. 21, 2008

(30) Foreign Application Priority Data

Aug. 2, 2004 (AT) ..... A 1323/2004

(51) Int. Cl.
*B32B 9/00* (2006.01)

(52) U.S. Cl. ..... 428/698; 51/307; 51/309; 427/419.1; 427/419.2; 427/419.4; 427/419.7; 428/697; 428/701; 428/702

(58) Field of Classification Search ..... 51/307, 51/309; 428/697, 698, 699, 701, 702, 704; 427/419.1, 419.2, 419.4, 419.7
See application file for complete search history.

(56) References Cited

U.S. PATENT DOCUMENTS

| | | | | |
|---|---|---|---|---|
| 3,837,896 | A * | 9/1974 | Lindstrom et al. | 428/336 |
| 3,955,038 | A * | 5/1976 | Lindstrom et al. | 427/419.4 |
| 5,863,640 | A * | 1/1999 | Ljungberg et al. | 51/307 |
| 6,187,421 | B1 | 2/2001 | Moriguchi et al. | |
| 6,217,992 | B1 | 4/2001 | Grab | |
| 6,251,508 | B1 * | 6/2001 | Ruppi | 428/698 |
| 6,426,137 | B1 | 7/2002 | Oshika et al. | |
| 7,090,914 | B2 * | 8/2006 | Yamagata et al. | 428/336 |
| 7,192,637 | B2 * | 3/2007 | Ruppu et al. | 428/701 |
| 2002/0187370 | A1 | 12/2002 | Yamagata et al. | |
| 2003/0211366 | A1 | 11/2003 | Ruppi et al. | |

FOREIGN PATENT DOCUMENTS

| | | |
|---|---|---|
| EP | 0965404 | 12/1999 |
| EP | 1348779 | 10/2003 |

* cited by examiner

*Primary Examiner* — Archene Turner
(74) *Attorney, Agent, or Firm* — Millen, White, Zelano & Branigan, P.C.

(57) ABSTRACT

The invention relates to an indexable insert of hard metal or cermet with a multi-layer surface coating for a machining of objects essentially made of metal or an alloy, in particular those of a polyphase material such as casting alloys and the like. To increase the service life of the tools with optionally improved machining surface, it is provided with a multi-layer coating that the outermost layer or cover layer is formed as an oxide layer, in particular of $\alpha$-$Al_2O_3$, whereby the layer beneath the cover layer and connected threto is composed of TiN.

18 Claims, No Drawings

INDEXABLE INSERT WITH A MULTI-LAYER COATING

CROSS-REFERENCE TO RELATED APPLICATIONS

The present application is a U.S. National Stage of International Application No. PCT/AT2005/000281, filed Jul. 18, 2005, which claims priority under 35 U.S.C. §119 of Austrian Patent Application No. A 1323/2004, filed Aug. 2, 2004.

BACKGROUND OF THE INVENTION

1. Field of the Invention

The invention relates to an indexable insert of hard metal or cermet with a multi-layer surface coating for cutting objects essentially made of metal.

The invention relates in particular to a cited indexable insert for a machining of parts of a polyphase material, such as casting alloys and the like.

2. Discussion of Background Information

In a cutting of workpieces made essentially of metallic materials, a sudden improvement in capacity was associated with the introduction of hard-metal or cermet tools which led to the development of indexable inserts in clamp holders.

The next sudden increase in tool capacity, possibly associated with an improvement in the quality of the machining surface, was generated by a coating of the surfaces of the indexable inserts with hard materials, such as nitrides, carbides, oxides and mixed forms thereof.

In order to further increase cost-effectiveness and surface quality in metal cutting, further developments took place in coating technology in layer composition and in layer thickness optimization.

The demands made on the surface coating of indexable inserts lie in principle in a high adhesion to the substrate and a reduction of the mechanical and thermal stress on the hard metal substrate.

For example, a hard metal cutting tool is known from EP A 1 348 779 with which a tough (bonding) zone close to the surface is produced on the hard metal substrate. A multi-layer coating of titanium nitride and/or titanium-carbo-nitride, $\alpha$-$Al_2O_3$, titanium-carbo-nitride or titanium-oxi-carbo-nitride with a titanium nitride outer layer in respectively determined thicknesses and thickness proportions is applied to this zone in order to achieve the high wear resistance and toughness of the tool.

According to the general technical knowledge of one skilled in the art in the field of coated indexable inserts, a tough surface bonding zone on the substrate and a multi-layer coating with a titanium nitride cover layer having a high hardness and wear resistance promotes the tool quality.

SUMMARY OF THE INVENTION

The present invention provides a further increase the quality of the tool and thus the cost-effectiveness of the machining. In particular the edge-holding quality of the indexable insert during a machining of polyphase materials, such as castings, e.g., gray cast iron alloys, is to be substantially increased.

Thus, in one embodiment, the present invention provides an indexable insert, where the outermost layer or cover layer can be formed as an oxide layer, in particular of $\alpha$-$Al_2O_3$, whereby the layer beneath the cover layer and connected thereto can be composed of TiN.

The advantages achieved with the outer layer combination according to the invention lie in a substantially increased durability of the overall coating even in the more loaded metal-cutting operation of an indexable insert.

In one embodiment, the present invention provides an indexable insert including an insert made of hard metal or cermet with a multi-layer surface coating for cutting objects, wherein the multi-layer surface coating includes a cover layer composed of an oxide, and a layer composed of TiN beneath the cover layer and connected thereto.

In another embodiment, the oxide cover layer has a thickness of 0.5 μm to 6.0 μm.

In another embodiment, the cover layer is the outermost layer of the multi-layer surface coating.

In yet another embodiment, the insert includes a metal or an alloy.

In one embodiment, the metal or alloy includes a polyphase material.

In another embodiment, the polyphase material includes casting alloys.

In yet another embodiment, the oxide cover layer includes $Al_2O_3$.

In one embodiment, the $Al_2O_3$ oxide cover layer includes $\alpha$-$Al_2O_3$.

In another embodiment, the oxide cover layer has a thickness of 0.9 μm to 5.0 μm.

In one embodiment, the present invention provides a method of making an indexable insert including providing an insert made of hard metal or cermet, and applying to the insert a multi-layer surface coating comprising an comprising a cover layer composed of an oxide, and a layer composed of TiN beneath the cover layer and connected thereto.

DETAILED DESCRIPTION OF THE INVENTION

Intensive tests showed that an oxide layer as the cover layer prevents chemical reactions of the titanium nitride layer beneath as far as possible and protects this highly hard finishing layer. Through this oxide cover layer, in particular embodied as a vitreous $\alpha$-$Al_2O_3$, layer, it was found that on the one hand reactions of TiN, as established above, with oxygen and in particular with carbon are prevented at the high temperatures on the insert occurring due to a metal-cutting, on the other hand a reduction of the thermal stress of the multi-layer layer and thus of the indexable insert occurs through the decreasing thermal conductivity with increasing temperature of the oxide layer.

For one skilled in the art in this field, the advantageous effect of oxide cover layers or vitreous $\alpha$-$Al_2O_3$, layers is extremely surprising, because they consistently have a lower hardness than the TiN layer beneath and yet, according to general expert opinion, the outermost layer should have the highest hardness and abrasion resistance. The contrary course of the thermal conductivity or thermal expansion with increasing temperature of the adjacent layers render obvious even to one skilled in the art a tendency of the cover layer to spall.

Scientific evidence has not yet been obtained but, contrary to the above expert opinion, it can be assumed that the structure of the boundary surface between TiN layer and an $Al_2O_3$ cover layer, preferably a $\alpha$-$Al_2O_3$ cover layer, accounts for an advantageous effect of the same. For manufacturing reasons TiN layers evidently have a structured surface formed by a microcrystalline and/or nanocrystalline shaping. A preferably $\alpha$-$Al_2O_3$ cover layer applied thereto according to the invention is spread across the entire surface, whereby a keyed bonding surface is produced with high bond strength and high shear resistance. If in the course of the chip removal, in particular of parts of an iron-based casting alloy, a mechanical/thermal stress of the cover layer now occurs, although this cover layer is thinned out by abrasion, it does not show any cracks or areal chips.

According to the invention, the cutting capacity of a tool or of an indexable insert is substantially increased by a so-called consumable oxide cover layer of $\alpha$-$Al_2O_3$, on a TiN layer.

It is particularly advantageous thereby if the oxide cover layer has a thickness of 0.5 μm to 6.0 μm, in particular 0.9 μm to 5.0 μm.

Larger layer thicknesses promote the tendency to surface crack formation and thus partial chipping of layer areas, however, a smaller thickness of the layer cannot produce the anticipated capacity increase for the tool.

The invention is further explained based on results obtained in the cutting of the interior surfaces of cast cylinder sleeves.

Identical indexable inserts were experimentally produced according to EP-A-1 348 779, some of them being provided with a cover layer of $\alpha$-$Al_2O_3$ according to the invention with a thickness of 2.1 μm.

The practical results in the internal turning of the cast sleeves achieved a 1.84-times service life of the tools on average with the coating according to the invention.

The invention claimed is:

1. An indexable insert comprising:

an insert made of hard metal or cermet with a multi-layer cutting surface coating, wherein the multi-layer cutting surface coating includes a cover layer composed of a vitreous oxide, covering the entire cutting surface, and a layer composed of TiN beneath the cover layer and connected thereto.

2. An indexable insert according to claim 1, wherein the oxide cover layer has a thickness of 0.5 μm to 6.0 μm.

3. The indexable insert according to claim 1, wherein the cover layer is the outermost layer of the multi-layer cutting surface coating.

4. The indexable insert according to claim 1, wherein the insert comprises a metal or alloy.

5. The indexable insert according to claim 4, wherein the metal or alloy comprises a polyphase material.

6. The indexable insert according to claim 5, wherein the polyphase material comprises casting alloys.

7. The indexable insert according to claim 1, wherein the oxide cover layer comprises $Al_2O_3$.

8. The indexable insert according to claim 7, wherein the $Al_2O_3$ oxide cover layer comprises $Al_2O_3$.

9. The indexable insert according to claim 2, wherein the oxide cover layer has a thickness of 0.9 μm to 5.0 μm.

10. A method of making an indexable insert according to claim 1 comprising:

providing an insert made of hard metal or cermet; and applying to the insert a multi-layer surface coating comprising a cover layer composed of a vitreous oxide and a layer composed of TiN beneath the cover layer and connected thereto.

11. The method according to claim 10, wherein the cover layer is the outermost layer of the multi-layer surface coating.

12. The method according to claim 10, wherein the oxide cover layer has a thickness of 0.5 μm to 6.0 μm.

13. The method according to claim 10, wherein the insert comprises a metal or an alloy.

14. The method according to claim 13, wherein the metal or alloy comprises a polyphase material.

15. The method according to claim 14, wherein the polyphase material comprises casting alloys.

16. The method according to claim 10, wherein the oxide cover layer comprises $Al_2O_3$.

17. The method according to claim 16, wherein the $Al_2O_3$ oxide cover layer comprises $\alpha$-$Al_2O_3$.

18. The method according to claim 12, wherein the oxide cover layer has a thickness of 0.9 μm to 5.0 μm.

* * * * *